United States Patent [19]

Kleen et al.

[11] 4,055,825

[45] Oct. 25, 1977

[54] VOLTAGE TRANSFORMER FOR HIGH VOLTAGE

[75] Inventors: Gerhard Kleen; Heinz Schiemann; Karl Allmendinger, all of Berlin, Germany

[73] Assignee: Siemens Aktiengesellschaft, Berlin and Munich, Germany

[21] Appl. No.: 745,692

[22] Filed: Nov. 29, 1976

[30] Foreign Application Priority Data

Nov. 28, 1975 Germany ..... 2554143

[51] Int. Cl.[2] ..... H01F 15/14; H01F 27/00

[52] U.S. Cl. ..... 336/70; 336/92; 336/96

[58] Field of Search ..... 336/69, 70, 84, 90, 336/92, 96, 223, 105

[56] References Cited

U.S. PATENT DOCUMENTS 1,034,929 8/1912 Reynders et al. ..... 336/70

*Primary Examiner*—Thomas J. Kozma

*Attorney, Agent, or Firm*—Kenyon & Kenyon, Reilly, Carr & Chapin

[57] ABSTRACT

A voltage transformer for use with high voltages. The transformer includes an insulating body in which is disposed a high-potential winding and a bushing laterally joined to the insulating body. In accord with the invention, the transformer is further provided with control electrodes in the form of conducting cylinders which are disposed concentrically with respect to the longitudinal axis of the bushing, thereby affording control of the bushing at both its ends. Moreover, in further accord with the invention, the high-potential winding is arranged adjacent to one side of the bushing so that its width extends over the control length thereof, and is comprised of subwindings which are metallically connected to the respective conducting cylinders such that a uniform voltage distribution results during the occurrence of surge voltages.

11 Claims, 5 Drawing Figures

20
41
22
40
31
4

3
38
39
34
35
36
2
39
37
33
1
30
29
28
14
27
13
26
15
25
16
17
24
18
23
19
32
21
12
10
11

VOLTAGE TRANSFORMER FOR HIGH VOLTAGE

BACKGROUND OF THE INVENTION

1. Field of the Invention

The invention relates to a voltage transformer for use with high voltages comprising an insulating body and a bushing laterally joined thereto. More particularly the invention relates to a voltage transformer of the aforesaid type in which the insulating body carries a high-potential winding which includes several serially connected subwindings which surround an iron core at spacings which increase in steps with the voltage, and which are connected with their outer winding end to a control electrode which extends into the bushing.

2. Description of the Prior Art

In one voltage transformer of this type, the insulating body carries individual coil forms which have cylindrical extensions for forming the bushing. The individual coil forms have on their outer as well as inner surfaces conductive coatings which are also provided on the inner and outer surfaces of the cylindrical extensions. Disposed on the individual coil forms are the subwindings forming the high-potential winding of the transformer. These subwindings are connected in series with each other by connecting the respective inner winding end of each subwinding to a coating on the coil form associated therewith, which coating, in turn, is connected to a conductive coating on the coil form of the subwinding of the next-higher voltage; the latter coating then being connected to the outer winding end of the subwinding of the next-higher voltage.

The above-described known voltage transformer has the disadvantage that it is complicated in design and therefore, expensive to manufacture. Moreover, it is further disadvantageous in that the conductive coatings on the coil forms and their interconnection with the subwindings results in an unfavorable surge voltage distribution.

In another known voltage transformer of the above-type, the high-voltage winding of the transformer comprises a number of series-connected subwindings with successively increasing diameters which are arranged axially side by side. The individual subwindings of the high-voltage winding are connected in series electrically by directly connecting the inner winding end of a subwinding to the outer winding end of the adjacent subwinding of the next-higher voltage. The individual subwindings are connected to each other mechanically by connecting straps, and the subwinding assembly so produced is held together by the innermost subwinding and the output lead of the outermost subwinding. The subwinding assembly is surrounded on the outside by a shielding cylinder which serves to control the voltage, and the indiviudual subwindings are impregnated with an impregnating resin. Moreover, $SF_6$ is preferably used as the insulating medium for the high-voltage insulation of the transormer.

The aforesaid voltage transformer is also disadvantageous in that it is not very well suited for construction by plastic or casting-resin techniques. In particular, the shielding cylinder required for controlling the voltage impedes the shrinking of the casting resin. There is thus a danger that voids and cracks might be formed in the cast resin which would have an adverse effect of the high-voltage dielectric strength.

It is therefore an object of the present invention to provide a voltage transformer of the above-type which is relatively simple to manufacture and has a high dielectric surge voltage strength.

SUMMARY OF THE INVENTION

The above and other objectives are realized in accordance with the principles of the present invention, in a voltage transformer of the type described above wherein: control electrodes in the form of conducting cylinders are disposed concentrically to the longitudinal axis of the transformer bushing, forming a bushing which is controlled at both its ends; the high-potential winding of the transformer is arranged adjacent to one side of the bushing in such a manner that its width extends over the control length of the bushing along that one side; and the subwindings of the high-potential winding are metallically connected to the respective conducting cylinders in such a manner that a uniform voltage distribution results during the occurrence of a surge voltage.

The voltage transformer of the invention as designed aforesaid is advantageous in that through the use of conducting cylinders as control electrodes, the design and, thereby, the construction of the transformer are simplified, while, at the same time, a uniform surge voltage distribution can be readily achieved. More particularly, by simply arranging the cylinders concentrically with a mutual spacing from each other, the coupling provided by the subwindings results in a substantially more favorable surge voltage control than could be realized with known voltage transformers having subwindings enclosed by electrodes. A surge voltage is, thus, distributed over the individual subwindings of the invention, depending on the favorable capacity distribution provided by the arrangement of the cylinders, so that overstressing of individual subwindings is largely precluded.

It is particularly advantageous in the transformer of the invention, to select the mutual spacings in the radial direction of the conducting cylinders and the lengths of the conducting cylinders such that, taking into account the capacities of the subwindings, the same capacities are obtained between the conducting cylinders. In such case, a surge voltage is uniformly distributed, via the cylinders, over the individual subwindings, thereby equalizing the surge voltage stress over the entire high-potential winding in an almost ideal manner.

It is also advantageous in the voltage transformer of the invention, to arrange the subwindings of the high-potential winding in such a manner that their outermost winding layer touches the outside of the conducting cylinders. This results in a particularly small, compact design for the transformer.

For design and production reasons, it is also considered advantageous in the transformer of the invention, if the high-potential winding is arranged in an insulating body which forms one cast-resin body with the bushing. On the other hand, it may also be advantageous if the bushing is manufactured separately and then cast-in or mechanically or electrically connected in some other manner with an insulating body formed itself as a casting and carrying the high-potential winding.

To achieve maximum dielectric surge voltage strength of the voltage transformer of the present invention, it is desirable to form the respective inner winding layer of the subwindings of one turn of flat ribbon which has a width corresponding to the width of the winding. The last turn at the outer winding end of each subwinding can likewise be designed similarly. It is considered particularly advantageous if the aforesaid flat ribbons comprise a wire fabric which is enclosed by impregnable insulating material, e.g., electrolyte paper.

The voltage transformer of the present invention can also be arranged in such a manner tat the end of its bushing extending away from the high-potential winding extends through a cover plate which is adapted to sealingly engage a metal capsule of a high-voltage switching installation which is completely insulated by an insulating gas or an insulting liquid. The insulating medium of the installation exerts only a small pressure on the capacitively controlled bushing of the voltage transformer because the pressure-receiving area of the bushing is relatively small. There is thus no danger of mechanical overstressing of the bushing and the insulating medium on the transformer side is not required to generate counterpressure. As a result, the transformer of the present invention need not be mounted in a pressure tank.

BRIEF DESCRIPTION OF THE DRAWINGS

The above and other features and aspects of the present invention will become apparent upon reading the following detailed description in conjuction with the accompanying drawings in which.

DETAILED DESCRIPTION

Figure 1:
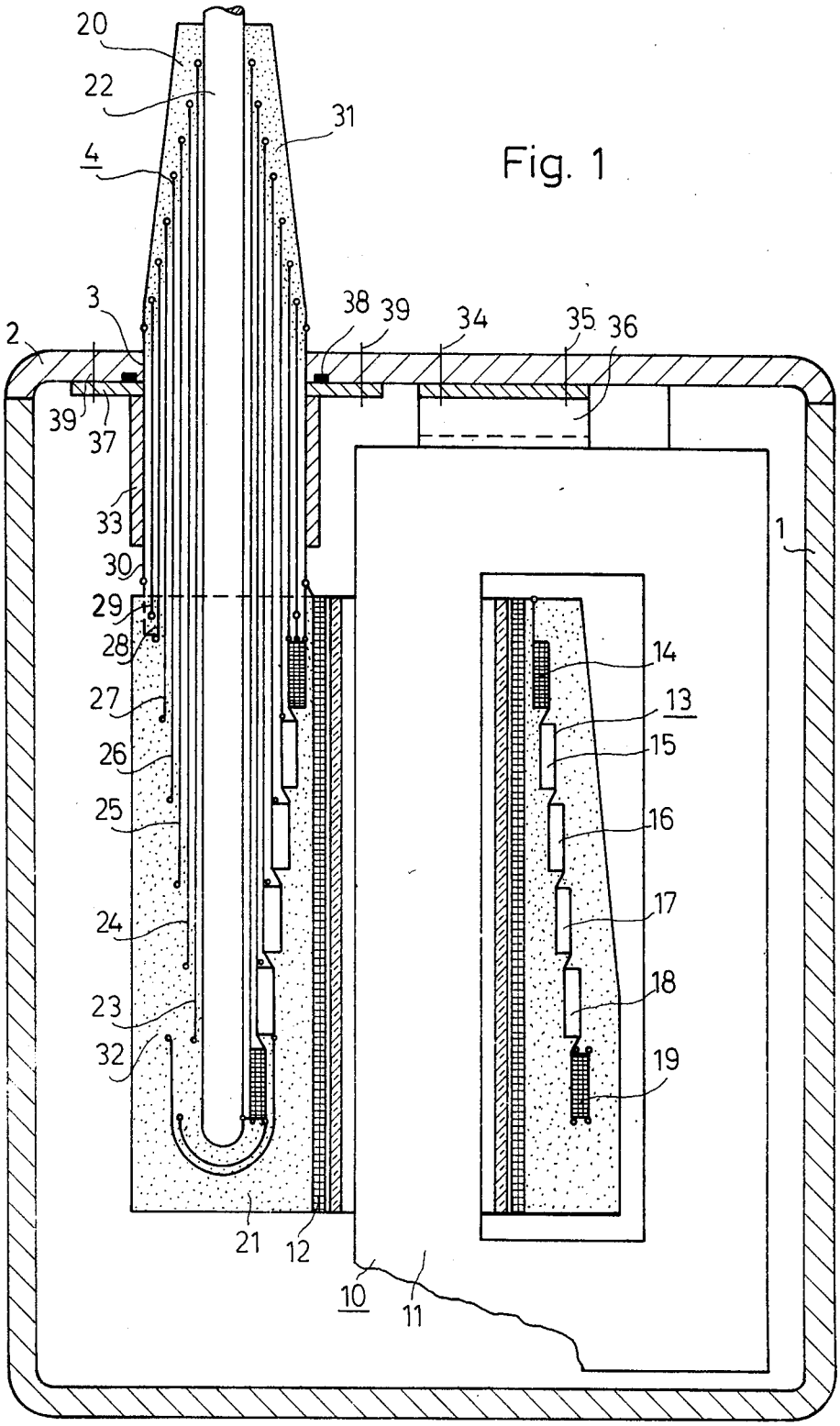
FIG. 1 shows a first embodiment of a voltage transformer in accordance with the priniciples of the present invention.

FIG. 1 shows a voltage transformer in accordance with the invention. The transformer is disposed within a housing 1 having a cover plate 2. The latter plate serves as the mounting plate for the internal parts of the transformer and includes a passage hole 3 through which extends the bushing 4 of the voltage transformer. The voltage transformer further includes an iron core 10 which is formed as a frame core and whose leg 11 is surrounded by a secondary winding 12 and a high-potential winding 13. The high-potential winding 13 comprises a plurality of subwindings 14, 15, 16, 17, 18 and 19, of which the subwinding 14 on the low-voltage side is spaced from the leg 11 by the smallest amount. The other subwindings 15 to 19 are arranged about the leg 11 in steps of increasingly larger spacing corresponding to increasing potential. The subwinding 19 on the high-voltage side, therefore, is spaced from the leg 11 by the largest amount.

The high-potential winding 13 comprised of the subwindings 14 to 19 is embedded in an insulating body 21 which is formed, preferably, of cast resin and which also includes the bushing 4. In the portion of the insulating body 21 containing the bushing 4, there are also embedded, the high-voltage lead conductor 22 of the bushing as well as the conducting cylinders 23, 24, 25, 26, 27, 28, 29 and 30, which form control electrodes for the bushing. The bushing 4 is controlled by the conducting cylinders at its upper end 31 and at its lower end 32, as the conducting cylinders 23 to 30 extend symmetrically on either side of the mounting 33 of the bushing 4. The subwindings 14 to 19 are connected to the conducting cylinders 23 to 30 in such a manner that the inner winding end of the low voltge subwinding 14 is connected metallically to the low-voltage cylinder 30 and the further subwindings 15 to 19 are connected to the cylinders 28 to 23 of correspondingly higher potential. The conducting cylinders 23 to 30 are each arranged in such a manner that they distribute surge voltages uniformly over the subwindings of the high-potential winding connected to them. Damage to the subwindings in case of surge stress is therefore prevented.

As may further be seen in FIG. 1, the voltage transformer is mounted on the cover plate 2 via screws 34 and 35 which pass through mounting brackets 36 disposed on the core 10. Furthermore, in order to separate the housing 1 from surrounding space in a moisture-proof manner, the bushing 4 is provided with a mounting flange 37. The latter flange is fastened to the cover plate 2 by means of screws 39, after the interposition of a gasket 38 between the flange and plate.

Figure 2:
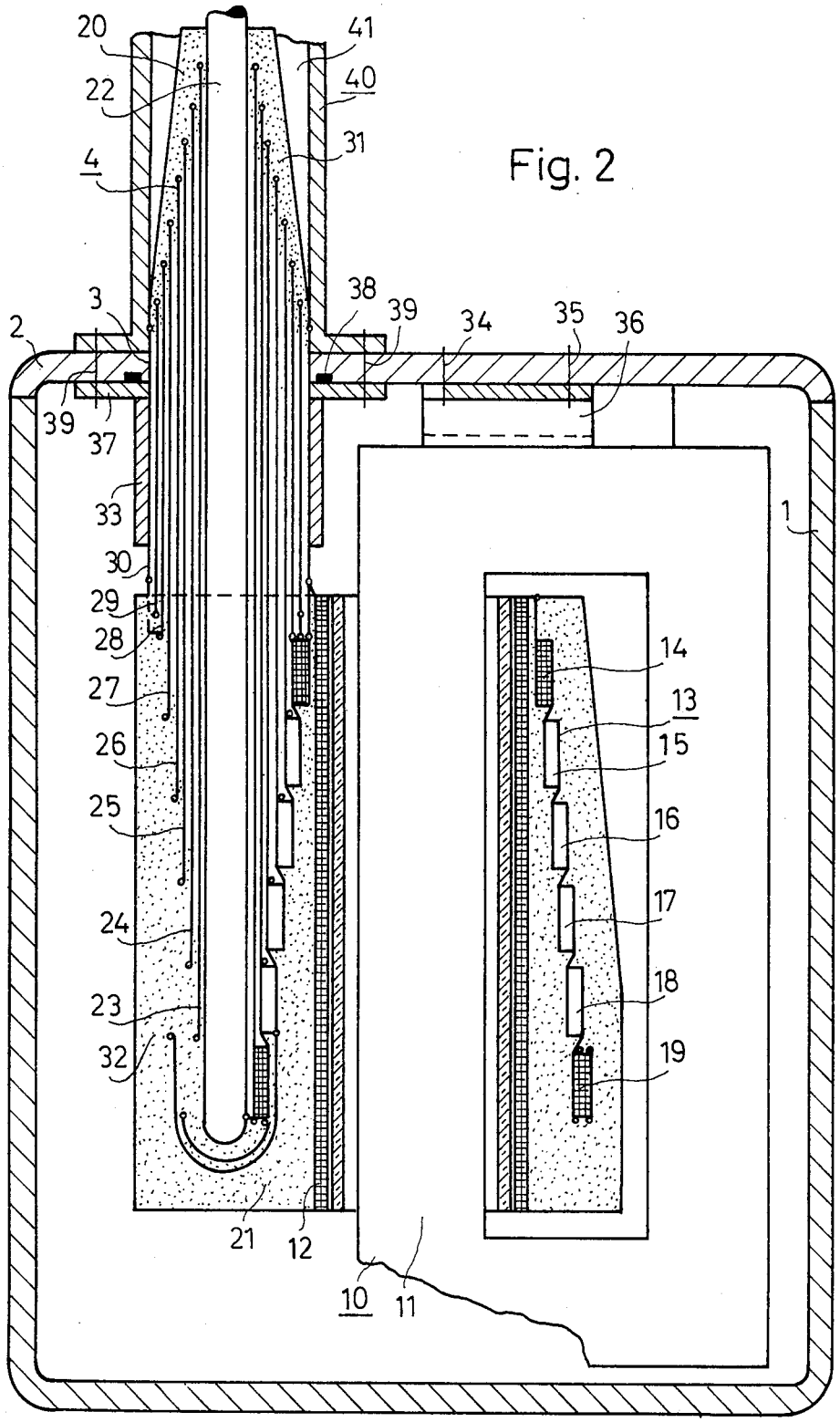
FIG. 2 shows the voltage transformer of FIG. 1 used in conjunction with a metal-encapsulated high-voltage switching installation.

FIG. 2 shows the transformer of FIG. 1 connected to a grounded metal capsule 40 of a high-voltage switching installation, the details of such installation not being shown in the figure. This high-voltage switching installation includes an inner conductor (not shown) at high-voltage potential, to which the high-voltage lead conductor 22 is metallically connected.

Contrary to voltage transformers for metal-encapsulated high-voltage switching installations with disk-shaped feed-throughs, the bushing 4 of the present voltage transformer is configured to have a small base area and is, therefore, loaded by a relatively small amount by the pressure of the insulting medium in the interior 41 of the metal encapsulation 40. In the interior of the housing 1 of the voltage transformer, no counterpressure, therefore, needs to be generated, so that the housing 1 need not be mounted in a pressure tank.

Figure 3:
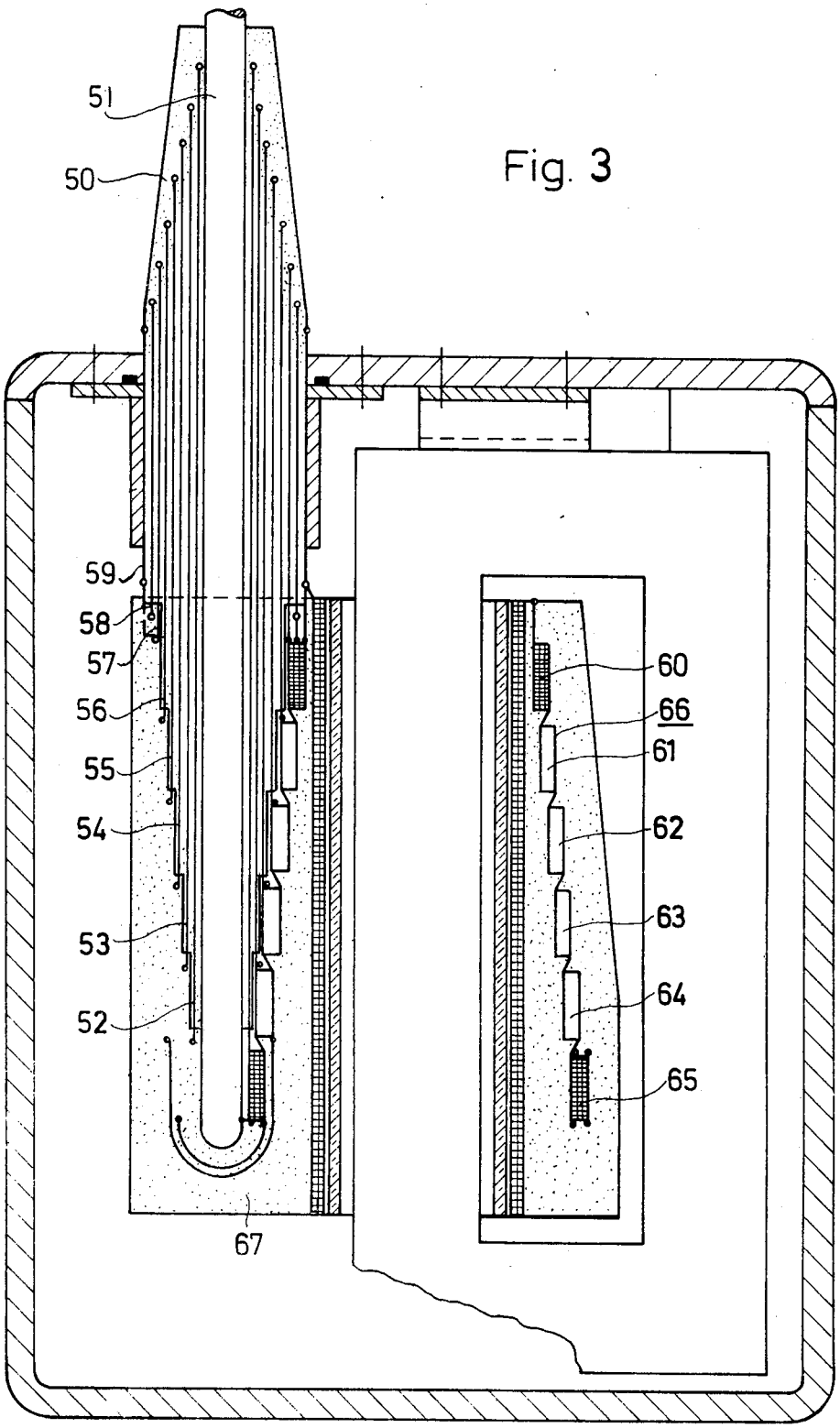
FIG. 3 shows a second embodiment of a voltage transformer in accordance with the principles of the present invention.

FIG. 3 shows a second embodiment of a transformer in accordance with the principles of the invention. This embodiment differs from that of FIG. 1 in that the transformer bushing 50, with its embedded high-voltage conductor 51 and conducting cylinders 52, 53, 54, 55, 56, 57, 58 and 59 is manufactured separately, for instance, as a casting of casting resin. Subwindings 60, 61, 62, 63, 64 and 65 of the high-potential winding 66, on the other hand, are carried in a further insulating body 67 which is also in the form of a casting. The insulating body 67 can be formed with the bushing 50 cast-in, but can also be manufactured by itself and then joined to the bushing 50 by additional casting or by means of mechancial connecting elements.

Figure 4:
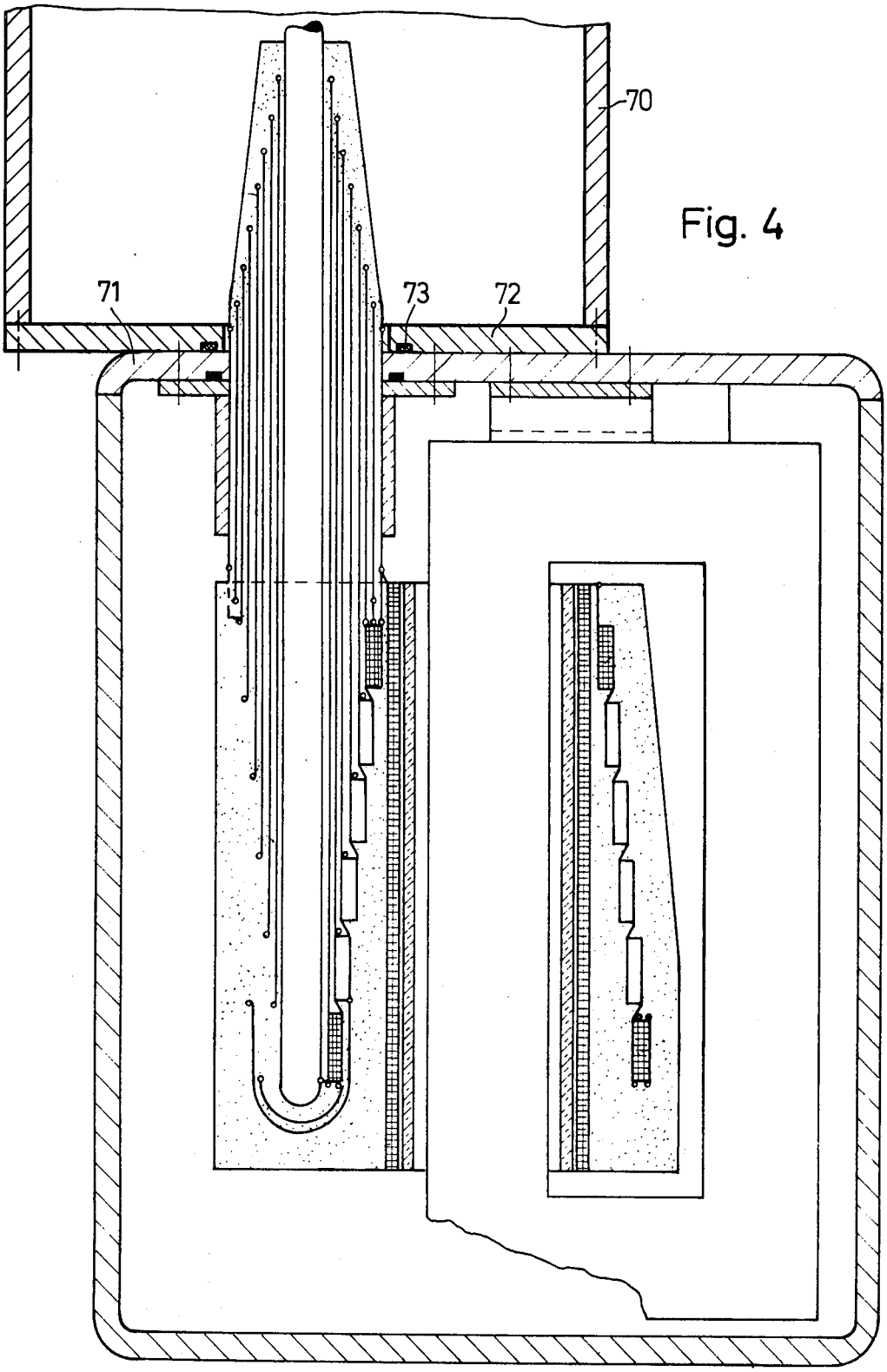
FIG. 4 shows the voltage transformer of FIG. 1 directly mounted to a metal-encapsulated high-voltage switching installation.

In the embodiment of the transformer shown in FIG. 4, the transformer of FIG. 1 is directly mounted to a grounded metal tube 70 of a completely insulated high-voltage switching installation. In this case, the cover plate 71 is connected to a termination plate 72 which closes off the grounded metal tube 70 and is equipped with a gasket 73. Inside the metal tube 70, there is an insulating gas or an insulating liquid as the insulation.

Figure 5:
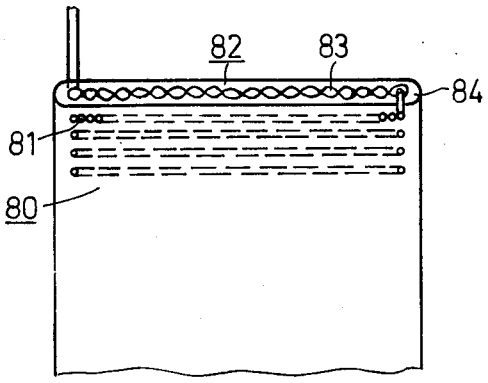
FIG. 5 shows a subwinding arrangement which can be employed in the voltage transformer of the present invention.

FIG. 5 shows a subwinding 80 which can be used as the subwindings of the high-potential winding of the transformer of the invention. The winding 80 is constructed as a cylindrical coil and contains a number of turns 81 formed of normal, round coil wire. The last turn 82 of the subwinding 80 is formed by a flat ribbon, the width of which corresponds to the width of the subwinding 80. As shown, the flat ribbon comprises a wire fabric 83 which is surrounded by impregnable insulating material 84.

What is claimed is:

1. In a voltage transformer for high voltages, said transformer including an insulating body carrying a high potential winding surrounding an iron core and a bushing laterally joined to said body, the high potential winding including a plurality of subwindings whose spacings from said iron core increase stepwise with voltage, the improvement comprising:

a plurality of control electrodes in the form of conducting cylinders disposed concentrically with respect to the longitudinal axis of the bushing, thereby providing control of said bushing at both its ends;

said high potential winding being arranged adjacent a side of the bushing so that its width extends over the control length of said side;

and said subwindings being metallically connected to the respective conducting cylinders so as to cause a uniform voltage distribution during surge voltages.

2. In a voltage transformer in accordance with claim 1, the improvement further comprising: the control electrodes being spaced from each other in the radial direction and being of such lengths that the capacities between the electrodes including the capacities of the corresponding subwindings are equal.

3. In a voltage transformer in accordance with claim 1, the improvement further comprising:

the subwindings being arranged so that their outer winding layers are in contact with the outsides of their respective control electrodes.

4. In a voltage transformer in accordance with claim 1, the improvement further comprising:

the insulating body and the bushing being in the form of a single plastic casting.

5. In a voltage transformer in accordance with claim 1, the improvement further comprising:

the bushing being a separate component from the insulating body; and the insulating body being a casting into which the bushing is cast.

6. In a voltage transformer in accordance with claim 1, the improvement further comprising:

the bushing being a separate component which is mechanically and electrically joined to the insulating body.

7. In a voltage transformer in accordance with claim 1, the improvement further comprising:

the inner winding layer of each subwinding comprising a turn of flat ribbon width corresponds to the width of the subwinding.

8. In a transformer in accordance with claim 1, the improvement further comprising:

each last turn at the outer winding end of each of the subwindings comprising a flat ribbon whose width corresponds to the width of the subwinding.

9. In a transformer in accordance with claim 7, the improvement further comprising:

each of said flat ribbons comprising a wire fabric surrounded by an impregnable insulating material.

10. In a transformer in accordance with claim 8, the improvement further comprising:

each of said flat ribbons comprising a wire fabric surrounded by an impregnable insulating material.

11. In a transformer in accordance with claim 1, the improvement further comprising:

a cover plate having an opening for receiving the end of the bushing extending away from the high potential winding, said cover plate being adapted to sealingly engage a portion of the metal encapsulation of a high-voltage switching installation which is completely insulated by an insulating medium, whereby said portion of the encapsulation of the switching installation can be closed off from the remaining portion of encapsulation of the switching installation when egaged by said cover plate.

* * * * *